United States Patent [19]

Fish et al.

[11] Patent Number: 4,469,245

Date of Patent: Sep. 4, 1984

[54] BULK LOADED CHANGE DISPENSING APPARATUS

[75] Inventors: Leonard A. Fish; David Sverdlik, both of Chicago, Ill.

[73] Assignee: Casino Technology, Schiller Park, Ill.

[21] Appl. No.: 276,711

[22] Filed: Jun. 23, 1981

[51] Int. Cl.[3] ..... B65H 5/02

[52] U.S. Cl. ..... 221/225; 221/253; 221/155

[58] Field of Search ..... 133/2, 4 R, 1 R; 414/119, 131, 114, 115, 112, 125; 198/433, 560, 607; 221/206, 207, 253, 225, 227, 231, 236, 241; 53/148, 150, 151, 532, 541

[56] References Cited

U.S. PATENT DOCUMENTS 3,152,721 10/1964 Golumbo et al. ..... 221/227 X
3,771,279 11/1973 Seragnoli ..... 53/151 X
4,324,523 4/1982 Zablocky ..... 414/131

FOREIGN PATENT DOCUMENTS 843955 8/1960 United Kingdom ..... 414/119

*Primary Examiner*—Stanley H. Tollberg
*Attorney, Agent, or Firm*—Hill, Van Santen, Steadman & Simpson

[57] ABSTRACT

A bulk loaded coin dispensing machine maintains a supply of coins to be dispensed in a bulk loaded magazine made up of a plurality of layers of coin rolls or tubes, each layer having plural rows and columns of coin tubes resting directly on each other, without intervening portions among the tubes. Coin tubes are stripped from the magazine a row at a time, and then carried by a transport conveyor and an elevator to a dispensing mechanism. The magazine carrier is movable independently of the stripper, conveyor and elevator to allow inventory replacement, and the stripper and conveyor are vertically adjustable in accordance with the decreasing height of the magazine as the coin rolls are dispensed. The stripper, conveyor, elevator and dispenser are operable asynchronously under control of a microprocessor.

17 Claims, 15 Drawing Figures

102
104
82
251
250
88
106
145
147
149
51
124
126
78
84
80
110
108
114
116
132
132a
134
118
128
122
120
130
134a
139
137
138
136
118a
48
68
40
160
48
42
62
44
212
45
76
56
112
241
109
240
68
50
66
53
55
144
142
140
160

FIG. 10
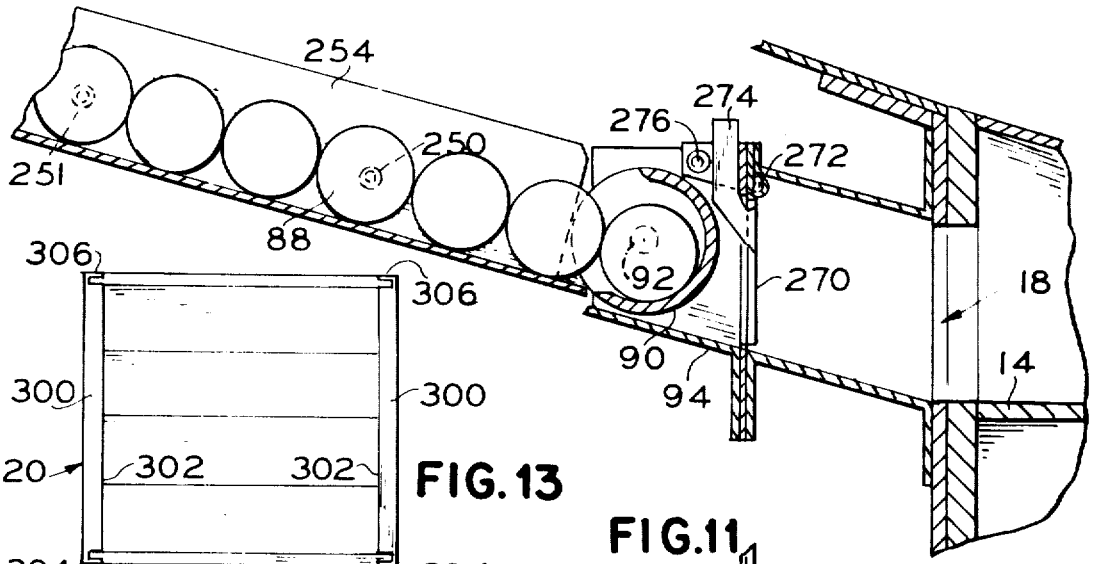
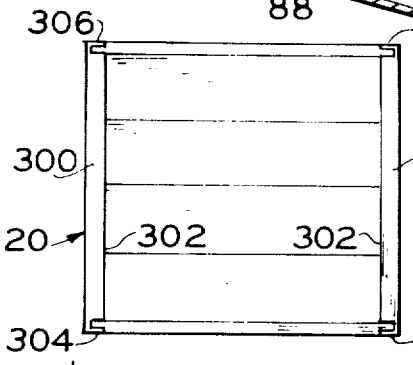
FIG. 13
FIG. 11
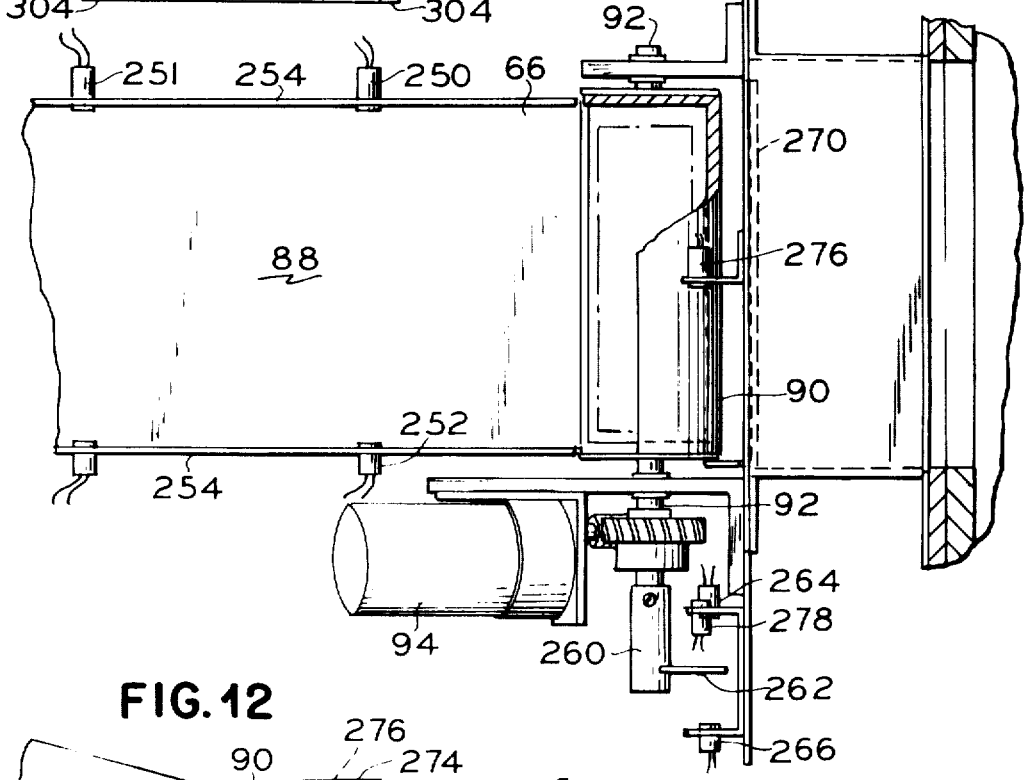
FIG. 12
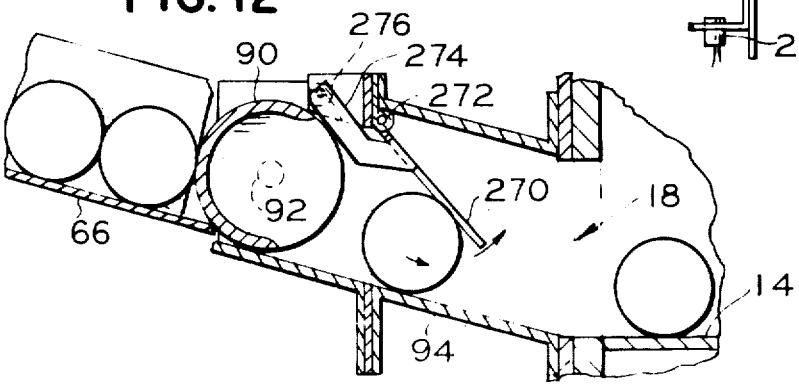

BULK LOADED CHANGE DISPENSING APPARATUS

BACKGROUND OF THE INVENTION

1. Field of the Invention

This invention relates to a bulk loaded change dispensing apparatus, and more particularly to a large capacity machine for dispensing change in exchange for paper currency.

2. The Prior Art

Change dispensing machines for changing a single dollar bill and a five dollar bill are known, and have utility in applications where a limited amount of change is required. In other applications, however, where large amounts of change or tokens are required, such as concentrated locations of coin receiving machines, the conventional change making machines are inadequate because of their limited capacity. It is therefore desirable to provide a change dispensing machine having a much greater capacity, so that longer periods of time may be allowed between servicing the machine to replenish its change inventory, thereby conserving the efforts of service personnel. In an environment in which there is a continuous demand for large amounts of change, such as in a gambling casino, a large capacity change making machine serves the purpose of providing change needed for efficient casino operation, and replenishment of the change inventory can be scheduled at infrequent periods during times of low demand.

It is also desirable to provide dispensing apparatus which can be easily and quickly loaded in a bulk form, without the need to insert individual coin rolls or tubes into separate compartments; and which is amenable to visual inspection of the inventory for the auditing purposes or the like.

SUMMARY OF THE INVENTION

It is a principal object of the present invention to provide a large capacity change bulk loaded dispensing machine with a capacity of thousands of coins which may be dispensed in exchange for paper currency of various denominations.

Another object of the present invention is to provide the change dispensing machine with sufficient capacity so that even under conditions of continuous use, its inventory needs to be replenished only occasionally.

Another object is to provide such a machine with a dispensing magazine which does not require intervening partitions of any kind among the coin tubes.

In one embodiment of the present invention there is provided a change dispensing machine having a magazine containing a plurality of layers of coin rolls or tubes, each of the layers being made up of a plurality of rows and columns of tubes, with a stripping device for unloading each layer one row at a time to a transport mechanism, which feeds the tubes seriatim to a dispensing mechanism where they are dispensed as required. The large magazine capacity of the machine of the present invention makes it possible to store and dispense a large quantity of coins or coin-like tokens without the need for frequent replenishment of the supply of the machine.

The change dispensing machine of the present invention makes it possible to replace or supplement cashiers or other clerks whose sole function is to make change, and the change making service is not interrupted by the need for frequently replenishing the inventory of change to be dispensed.

These and other objects and advantages of the present invention will become manifest by a review of the following description and the accompanying drawings.

BRIEF DESCRIPTION OF THE DRAWINGS

Reference will now be made to the accompanying drawings in which:

FIG. 10 is a side view of the dispensing ramp of the present invention, with the dispensing escapement shown in closed position;

FIG. 11 is a top view of the apparatus of FIG. 10;

FIG. 12 is a side elevational view of a portion of the apparatus of FIG. 10, with the dispensing escapement open; and FIGS. 13–15 are views illustrating an arrangement for securing temporary cover sheets in place about the magazine.

DESCRIPTION OF THE PREFERRED EMBODIMENT

Figure 1:
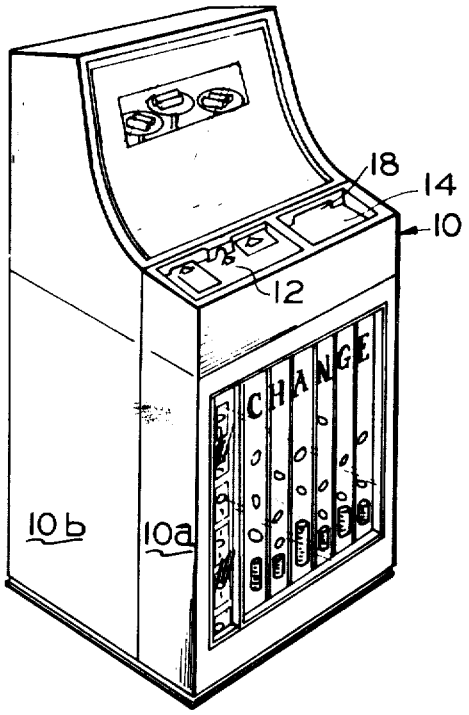
FIG. 1 is a perspective view of an illustrative embodiment of the present invention.

Referring first to FIG. 1, a change making machine in accordance with the present invention is shown in perspective view. The change machine has an exterior case 10, with a bill receiver mechanism 12, and a coin dispensing compartment or tray 14. The currency receiving mechanism 12 has a slot which is adapted to receive an item of paper currency (a bill) and present it to a validating mechanism 16 (FIG. 2) mounted within the case 10. The validing unit 16 determines the genuineness of the currency fed into the machine, and its denomination, and controls the dispensing mechanism to dispense the appropriate number of coin tubes or rolls to the dispensing tray 14. On or more coin rolls are dispensed onto the tray 14 through a slot 18 by means described hereinafter. The number of coin rolls which are dispensed depends on the denomination of the bill inserted into the machine at the currency receiving station 12.

Figure 2:
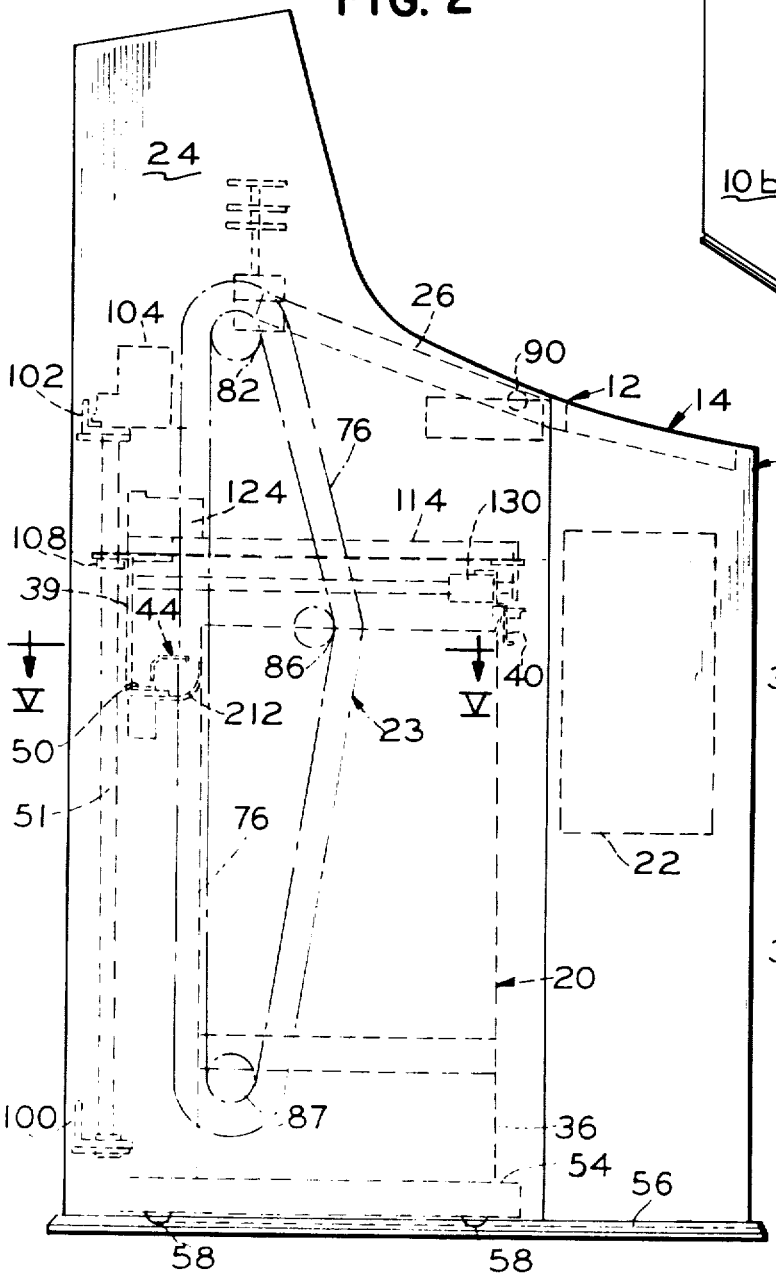
FIG. 2 is a vertical cross-sectional view of the apparatus of FIG. 1.

FIG. 2 is a side view of the case 10, showing the relative locations of the unit 16, and other components of the machine. A magazine 20 is provided for storing a multiplicity of coin tubes in a plurality of horizontal layers, each layer being made up of a plurality of rows and columns of the tubes. The rows extend across the width of the magazine, and the columns extend from front to back. The topmost layer of coin tubes is stripped from the magazine, one row at a time, by pushing the entire layer rearwardly ejecting the rearmost row onto a tilt tray 44, which tips the tubes into an upright position on a horizontal conveyor belt 50, which carries the tubes laterally to an elevator mechanism 23 powered by a drive chain 76. The tubes are then lifted by the elevator to an upper portion 24 of the machine, from which the tubes are rolled down a ramp 26 to a dispensing unit 90, which dispenses them one at a time into the receiving tray 14.

A microprocessor 22 is provided within the case 10, for controlling operation of the currency validator 16, and for operating the dispensing mechanism in response to recognition of a genuine currency bill of given denomination.

Figure 3:
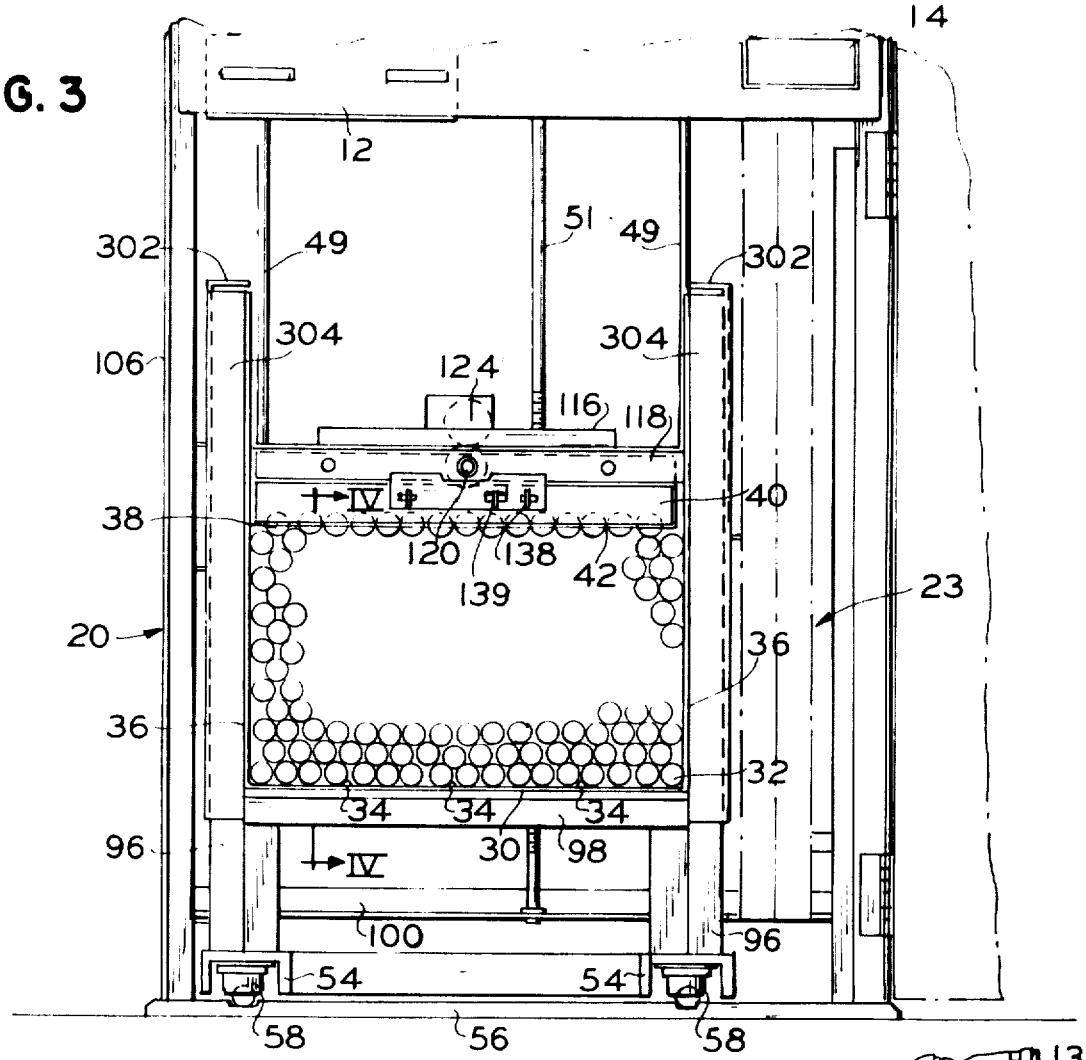
FIG. 3 is a front view of the magazine portion of the apparatus of FIG. 2.

FIG. 3 illustrates a front view of the magazine 20. A support plate 30 is provided for supporting the bottom layer 32 of coin rolls, in the magazine, and a plurality of stops 34 on the upper surface of the plate 30 maintain the coin columns in alignment with each other and in equally spaced arrangement. A second layer is supported on the first layer 32, with each coin roll of the second layer being supported on two adjacent rolls of the first layer. The second layer has one fewer coin rolls than the first layer. The third layer rests on the second layer, and has the same configuration as the first layer, and subsequent layers repeat the arrangement, so that each layer is substantially horizontal. Side walls 36 confine the end tubes of each row.

Figure 4:
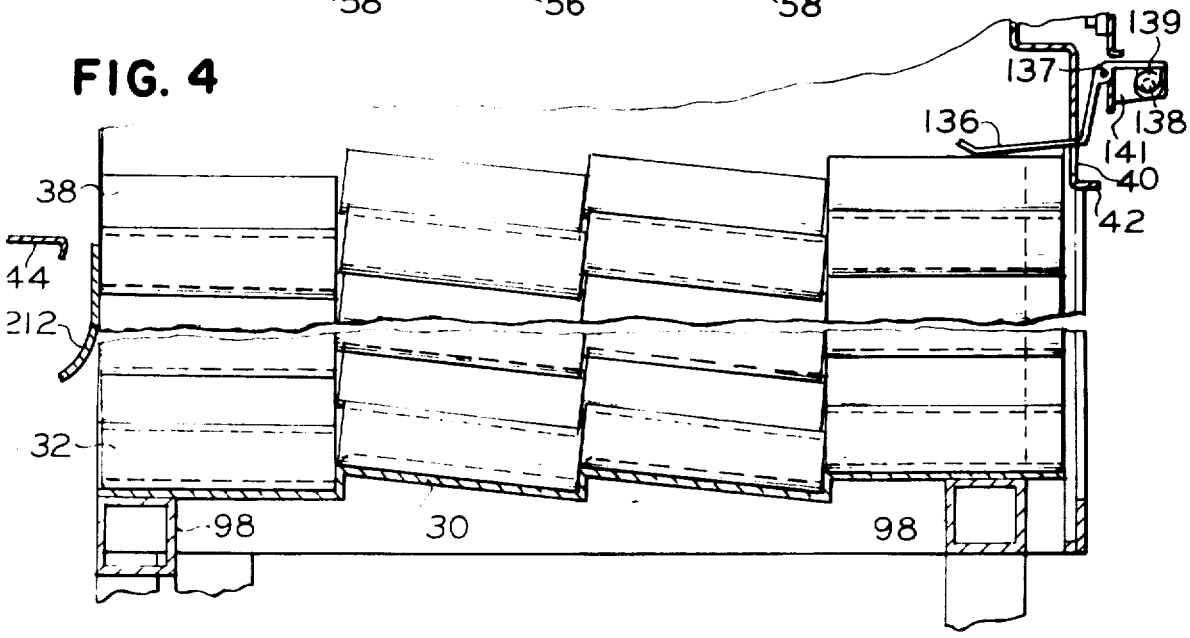
FIG. 4 is a side view of a portion of the apparatus of FIG. 3, taken along the line IV—IV.

FIG. 4 shows vertically aligned columns in a plurality of layers, and it can be seen that the upper surface of the plate 30 has a plurality of zones arranged in a ratchet shape, to allow the coin tubes of each column to engage each other so that the upper extremity of the front end of each coin tube is somewhat higher than the upper extremity of the rear end of the adjacent tube in the column. This facilitates stripping the coin tubes from the magazine. The extreme forward and rearmost zones are horizontal, to facilitate loading the magazine, and to facilitate endwise motion of the coin tubes onto the tilt tray 44.

The tubes are stripped by a pusher bar or stripper 40, disposes forwardly of the topmost layer 38, the bottom extremity 42 of the pusher bar 40 being aligned with the forward row of the top layer 38. The pusher bar 40 moves rearwardly, pushing the entire upper layer 38, for a distance of one row until the last row of the upper layer is ejected onto the tilt tray 44. A stop 46 adjacent the rear end of the second layer prevents the second layer from being moved rearwardly by the pusher bar 40. The tilt tray 44 is tilted rearwardly to deliver the tubes to a transport conveyor, and each time the tilt tray 44 is cleared, the pusher bar 40 moves rearwardly an additional distance corresponding to the length of a coin tube, thereby pushing a new row of coin tubes onto the tray 44. When all of the rows of a layer have been pushed onto the tilt tray 44, the pusher 40 retracts forwardly to its initial position (shown in FIG. 4), and then is lowered into operative position in relation to the next layer which has become the new top layer. The tray 44 and the transport conveyor is lowered as the pusher 40 is lowered.

Figure 6:
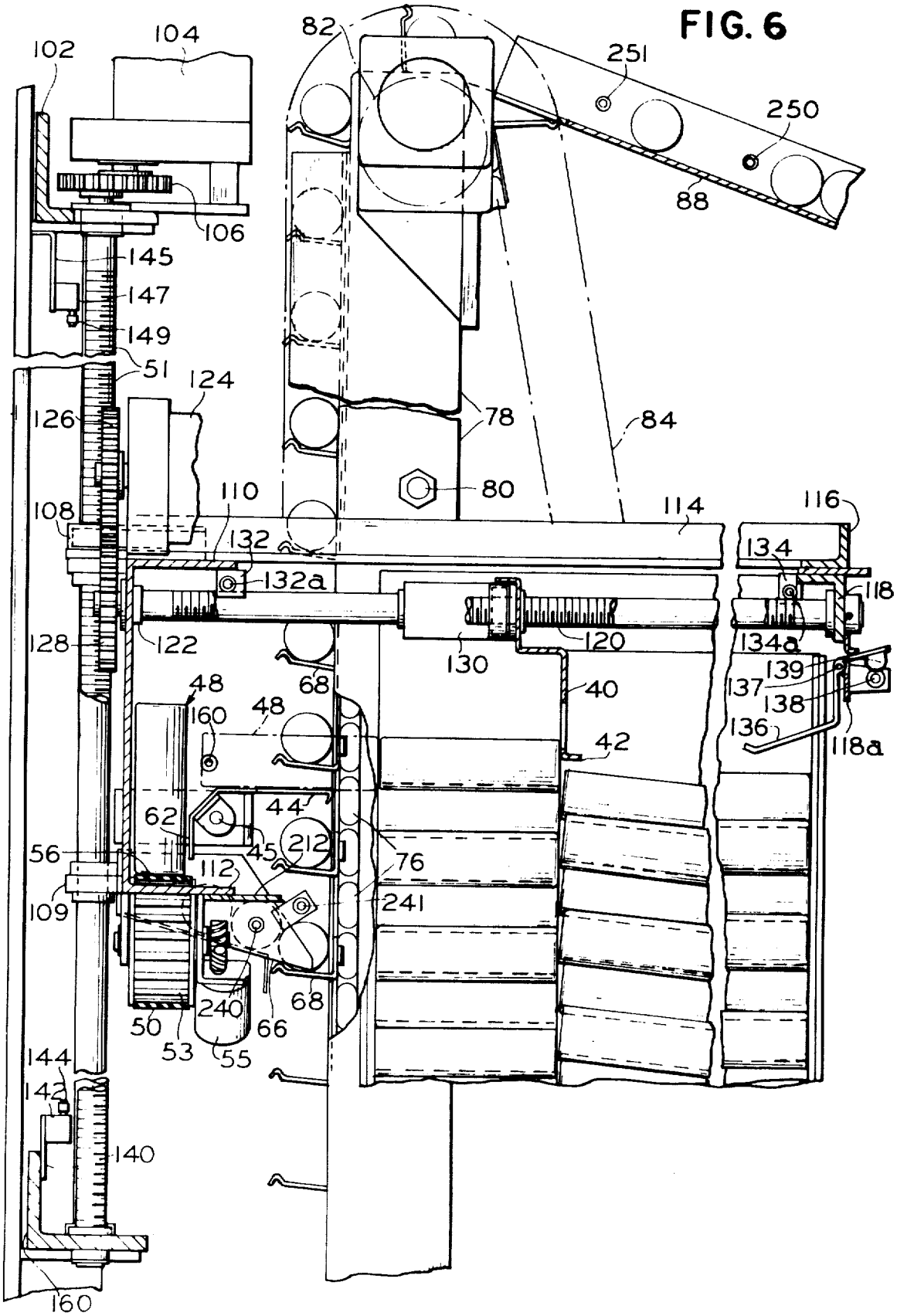
FIG. 6 is a side view of a portion of the apparatus of FIG. 5.

As shown in FIGS. 3 and 6, a lead screw 51 is provided for moving the pusher bar on stripper 40, and the transport conveyor up and down. A pair of guides 49 are mounted in fixed position within the case 10, and they guide the vertical motion of a carriage which supports the pusher 40 and its associated mechanism, as well as the transport conveyor mechanism.

The magazine 20 is supported by base members 54, which are each supported in rolling relationship on a base plate 56 by roller assemblies 58.

The roller assemblies each have steel balls adapted to roll along individual grooves on the upper surface of the bottom plate 56, so that the entire magazine area may be pulled forward, together with a forward section **10*a* of the case 10**, in order to allow replenishing of the magazine, or replacement of the entire magazine with a full unit.

The tilt tray 44 is mounted on a pivot stud 45 (FIG. 6) at each side of the case 10, and is adapted to be rotated from its horizontal position to a vertical position. The rotation of the tray transfers coin rolls 48 onto the upper surface of the conveyor belt 50 located at the rear of the tray 44. The conveyor belt 50 is supported by pulley 52 and 53 (FIG. 7), and forms a transport conveyor for transporting the coin rolls 48 from the area behind the tilt tray 44. The pulley 53 is driven by a motor 55 through a worm gear drive.

Figure 5:
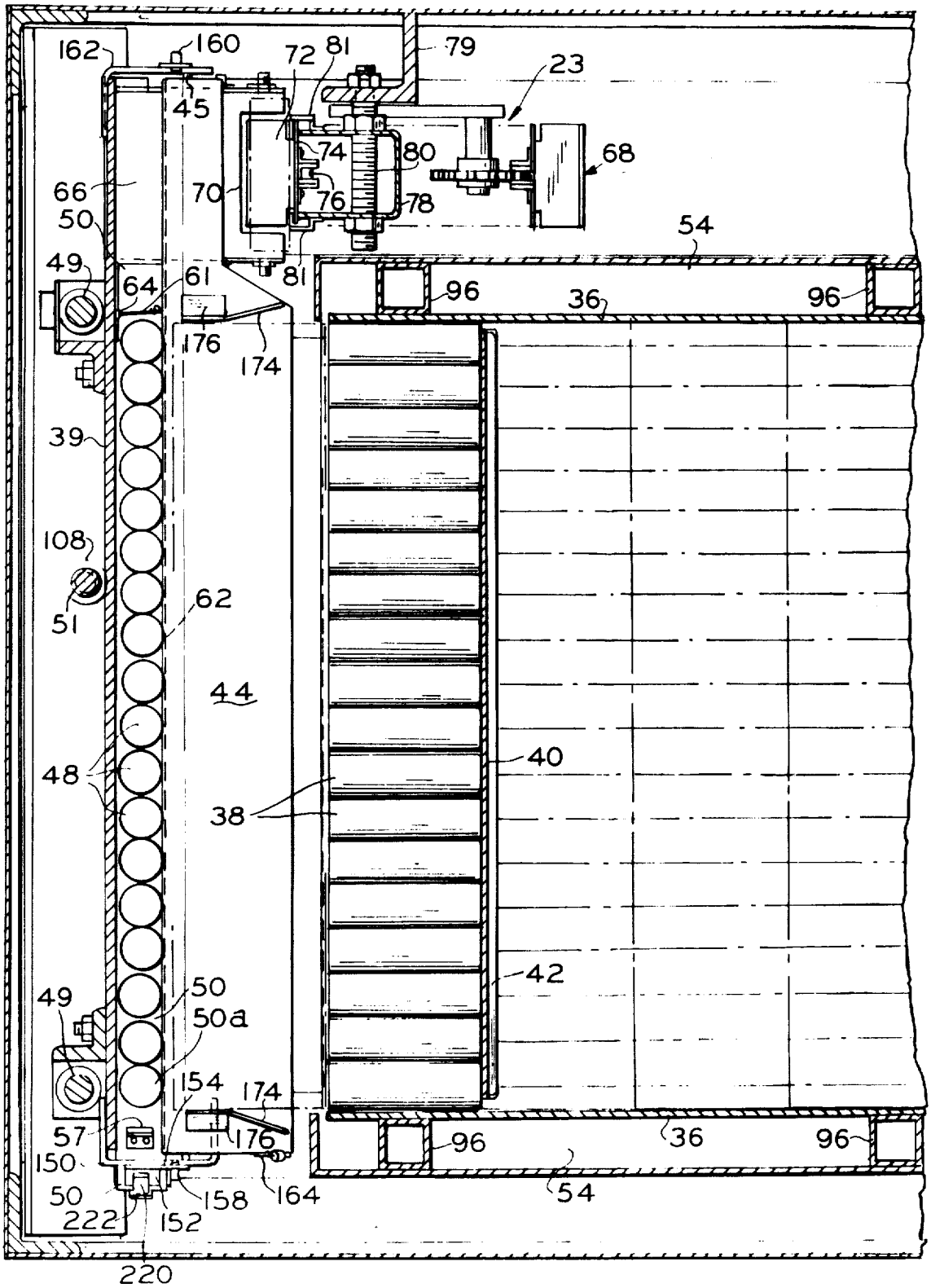
FIG. 5 is a plan view of a portion of the apparatus taken along line V—V in FIG. 2.

FIG. 5 illustrates the condition of the apparatus after the tilt tray 44 has rotated the coin rolls 48 into position on the conveyor belt 50, and after the tilt tray 44 is subsequently returned to its horizontal position.

A stop member 57 is secured to the upper surface of the conveyor belt 50, and maintains the last coin roll **50*a* in upright position, as the entire row is transported, sliding between the rear wall 39 and a wall 62 (FIG. 6) which is integrally formed with the tilt tray 44**.

A flap 61 is hinged to the wall 39, and is interposed in the path of the coin rolls as they are transported by the conveyor belt 50. The flap 61 holds back the coin rolls in the row, but is adapted to pivot about the hinge 64 so as to allow the end most roll to pass, as the conveyor belt 50 is advanced. The flap 61 then springs back to retain the next coin roll in upright position on the conveyor belt. A spring 63 (FIG. 7) biases the flap 61 toward its closed position.

When a coin roll has passed beyond the flap 61, the bottom end of the roll is only partially supported on the conveyor belt 50, so that the coin roll rotates forwardly to a horizontal position, falling onto a ramp 66. The ramp 66 slopes downwardly toward the front of the machine (FIG. 6), and allows the coin tube to roll forward, until it is in position to be received by one of a series of carriers 68, of the elevator mechanism 23.

The forward portion of the ramp 66 slopes downwardly, and coin rolls are adapted to roll onto the platforms 72 of individual tube carriers 68 as they move upwardly past the ramp 66. Each tube carrier 68 holds but a single coin tube. The platform 72 of each carrier is secured to a back plate 74, which is attached to one of the links of the chain 76. An elongated U-shaped bracket 78 is adjustably secured to a frame member 79 by means of a screw 80, and retaining members 81 secured to the bracket 78 retain the edges of the plate 74 in position on its carrier 78 and is lifted by the chain 76.

As shown in FIGS. 2 and 6, the chain 76 passes vertically upwardly over a sprocket 82, and then downwardly in a path around sprockets 86 and 87, and then vertically again. Because the transport conveyor cooperates with the vertical leg of the elevator, the carriage carrying the transport conveyor feeds the elevator over a range of vertical positions, as successive layers are stripped from the magazine.

A ramp 88 is positioned adjacent the upper sprocket 82, and the coin rolls are adapted to leave the carriers of the elevator and roll downwardly on the ramp 88, as shown in FIG. 6.

Associated with the forward end of the ramp 88 is a hollow circular dispensing member 90. One side 91 of the cylinder is open, to enable a roll to enter the interior of the dispensing cylinder 90 from the ramp 88. FIG. 10 illustrates the dispensing cylinder in position to receive a coin roll from the ramp 88. The dispensing cylinder 90 is supported for rotation on a shaft 92, and a motor 94 is adapted to rotate the shaft 92 through a worm gear drive. As the dispensing cylinder 90 rotates, the open side 91 is rotated toward the lowest coin tube, permitting the coin tube to roll downwardly on a ramp 94 until it reaches the dispensing tray 14.

Though the sequence described above, each coin roll is stripped from the magazine 20 onto the tilt tray 44, from which is it tilted onto the conveyor belt 50, and tilted again onto the ramp 66 which allows the coin roll to roll down to position to be lifted by the elevator. At the top of the elevator the coin roll rolls down ramp 88 to the dispensing cylinder 90 and subsequently down the ramp 94 to the dispensing tray 14. Although these operations are sequential with respect to each individual coin tube, some of these operations are carried on simultaneously, so that a continuous supply of coin rolls is assured on the ramp 88. Accordingly, each time the dispensing cylinder 90 is rotated one revolution, one coin roll is dispensed into the receiving tray 14. Apparatus is provided for insuring that the elevator mechanism 23 operates continuously as long as there are less than seven rolls available for dispensing in position on the ramp 88, and the transport conveyor 50 operates whenever there is no roll available on the ramp 66 waiting for pick up by the elevator mechanism. A mechanism is also provided for determining when no more coin rolls remain supported by the conveyor belts 50, to reverse the direction of drive of the conveyor, preparatory to a new row of coin rolls being tipped from the tilt tray 44 onto the conveyor belt. A mechanism is also provided for reloading the tilt tray with a row of coin rolls immediately after it has been tilted, so the tilt tray remains ready to tilt a row of coin rolls onto the conveyor belt 50 as soon as it has been emptied. Similarly, a mechanism is provided for retracting the pusher 40 as soon as the last row of coin rolls has been removed from a layer of the magazine, and lowering the pusher 40, tilt tray 44 and conveyor belt 50, to enable the pusher 40 to remove a row of coin tubes from the next successive layer. By overlapping the sequences involving the movements of the coin tubes, it is possible to assure a continuous supply of coin tubes to the receiving tray 14 even though the individual feeding operations are intermittent.

The case 10 (FIG. 1) has a front part 10*a* and a rear part 10*b*, the front part being hinged at one side to the rear part, so it can be swung open to allow replacement or replenishment of the magazine. The magazine can roll forwardly on roller assemblies 58 when the when the machine is opened for replenishing the inventory. The base members 54 support a plurality of columns 96, to which are secured cross pieces 98 which support the magazine support plate 30. The side walls 36 are also secured to the support columns 92, so the entire magazine represents a rigid U-shaped structure, which are open at the front and back when in plate in the machine. The pusher 40 is raised above the highest layer of the magazine when the magazine is pulled forwardly for reloading. Preferably the case portions 10*a* and 10*b* are held together by a key operated locking mechanism.

The lead screw 51, by which the transport conveyor is lowered, is journalled at its upper and lower ends in brackets 100 and 102, (FIG. 6) which are secured to the interior of the case 10*b*. The bracket 102 supports a motor 104 which drives the screw 51 through a gear mechanism 106. A housing 108 is threadably received on the screw 51, and supports a U-shaped carriage member 60 so that the carriage 60 is raised and lowered as the screw 51 is turned. A second housing 109, also secured to the carriage 60, is also in threaded engagement with the screw 51. The carriage 60 has an upper horizontal leg 110 and a lower horizontal leg 112. The lower leg supports the sprockets for the transport conveyor belt 50. The upper leg supports a beam 114 on each side of the machine which extends forwardly from the carriage 60 to the front of the magazine. The front ends of the beam 114 are joined with a member 116, which supports a bracket 118 journalling the forward end of a screw 120, which drives the pusher 40. The rear end of the screw 120 is journalled in a bearing 122 supported on the carriage member 60. The upper leg 110 also supports a motor 124 which is connected to the screw 120 through gears 126 and 128, the latter being fixed to the end of the screw 120. A housing 130 is threadably mounted on the screw 120 and supports the pusher 40, so that the pusher can be moved forward and back as the screw 120 is rotated.

A bracket 132 is supported on the underside of the leg 110, on one side of the housing 130, and a corresponding bracket (not shown) is supported below the leg 110 on the other side of the housing 130. The two brackets support a light source (not shown) and photo detector, such as a photocell 132*a*, respectively, so that when the housing 130 is in its rearward position, light from the light source cannot reach the photocell 132*a*, thereby generating a signal indicating the position of the housing 130.

On the bracket 118, a further bracket 134 is supported on one side of the housing 130 with a corresponding bracket (not shown) on the other side of the housing 130. These brackets are also provided with a light source 134*a* and photocell 134*a*, respectively, for identifying the forward position of the bracket 130, when the pusher 40 is forwardly of all of the coin rolls in the magazine.

The bracket 118 has another bracket 118*a* which has a feeler member 136 pivotally supported on a shaft 137. The feeler passes through an aperture in the central part of the pusher bar 40, and has a vane 139 which, as shown in FIG. 6, is interposed in the path between a light souce and a photocell 138, supported on walls 141 secured to the rear surface of the pusher bar 40. The feeler 136 rests on top of the topmost layer of coin tubes. When the stripper 40 is being lowered into position relative to the top row of coin tubes, the light path is unobstructed until the feeler reaches the top layer and rotates the vane 139 into the light path. This operation assures that the stripper is at the correct height to strip the top layer.

The bracket 100 supports a bracket 140 on which a limit switch 142 is mounted, having an actuator 144. The actuator 144 is adapted to engage the housing 109, when the carriage supporting the transport conveyor and the pusher are in their lowest position. Another bracket 145 is secured to the upper portion of the inside of the case and mounts a limit switch 147, with an actuator 149. The actuator 149 is adapted to engage the upper surface of the bracket 108, when the carriage has been moved to its upper most position, when the pusher 40 is above the topmost layer of a fully loaded magazine.

Figure 7:
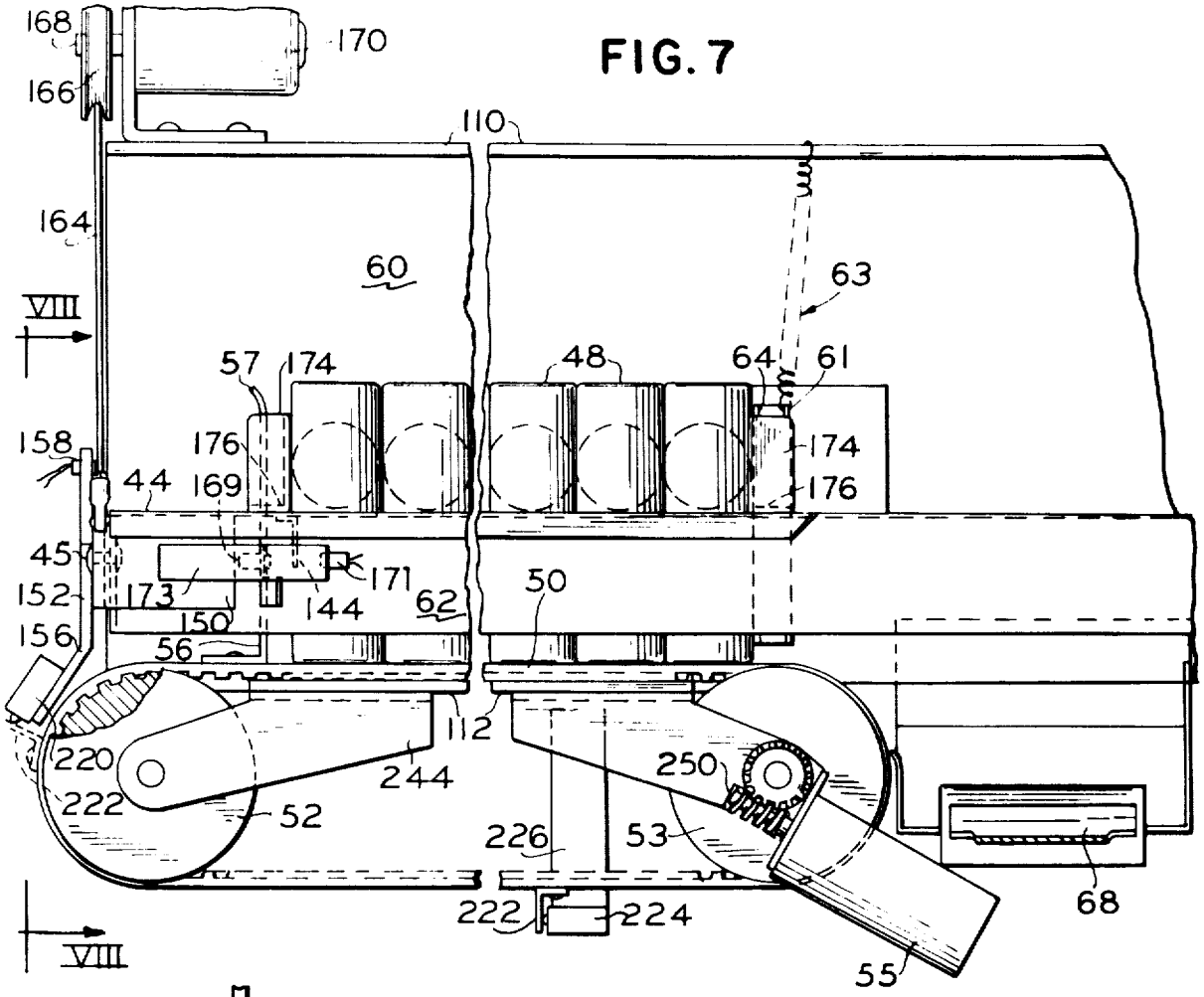
FIG. 7 is a side elevational view of part of the transport portion of the apparatus of FIG. 5.

The tilt tray 44 has a tab formed integrally at each end thereof, which is supported on the pivot stud 45, allowing the tilt tray to be pivoted between its horizontal and vertical position. A U-shaped bracket 150 (FIG. 5) is secured to one end of the carriage 60, for supporting the pivot stud 45, as shown in FIG. 7. It also supports a bracket 152, which has an upper leg 154 and a lower leg 156. A photocell or light source 158 is secured to the upper end 154, in alignment with a light source or photocell 160 secured to a bracket 162 at the other side of the magazine (FIG. 5). This establishes a light beam which is interrupted by a row of coin rolls when they are pushed into position onto the tilt tray 44. The forward end of the tilt tray 44 is secured to a wire link 164 by which the tilt tray is raised and tilted into its vertical position. At its upper end, the wire link 164 is wrapped for part of a revolution around a pulley 166, and the end of the link 164 is secured to the pulley, and the pulley is fixed to a shaft 168. The shaft 168 is rotated by a rotary solenoid 170, so that the link 164 may be pulled upwardly, when the solenoid 170 is energized, thus tilting the tilt tray 44 to its vertical position. A spring 172, interconnected between the forward end of the tilt tray 44 and the lower arm 112 of the carriage 60, returns the tilt tray 44 to its horizontal position when the solenoid 170 is de-energized.

Figure 9:
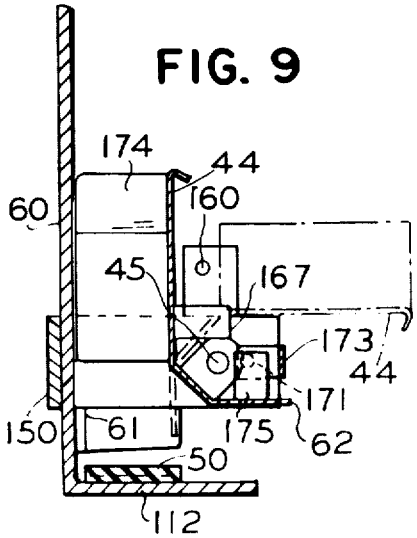
FIG. 9 is a view similar to FIG. 8, showing the tilt tray in operated position.

A flap 167 is secured to the bottom of the tilt tray 44, and is interposed between a light source 169 and a photocell 171, both of which are supported on a bracket 173, which is mounted on the U-shaped member 150. When the tilt tray 44 is in its horizontal position, the flap 167 is interposed in the light path between the source and photocell 169 and 171, whereas a second flap 175, connected to the rear wall 62 of the tilt tray, is interposed between the same light source and photocell when the tilt tray is in its vertical position, as shown in FIG. 9. Accordingly, the same photocell and light source combination furnishes separate signals when the tilt tray is in either of its two positions. A pair of funnel members 174 are secured to the upper surface of the tilt tray 44, adjacent the left and right sides of the magazine, to funnel coin rolls into position on the tilt tray 44 and prevent them from rolling in either direction on the tilt tray. Each funnel member 174 is formed of sheet metal and is secured to the tilt tray 44 by means of an L-shaped bracket portion 176 integral with the funnel member 174.

Figure 8:
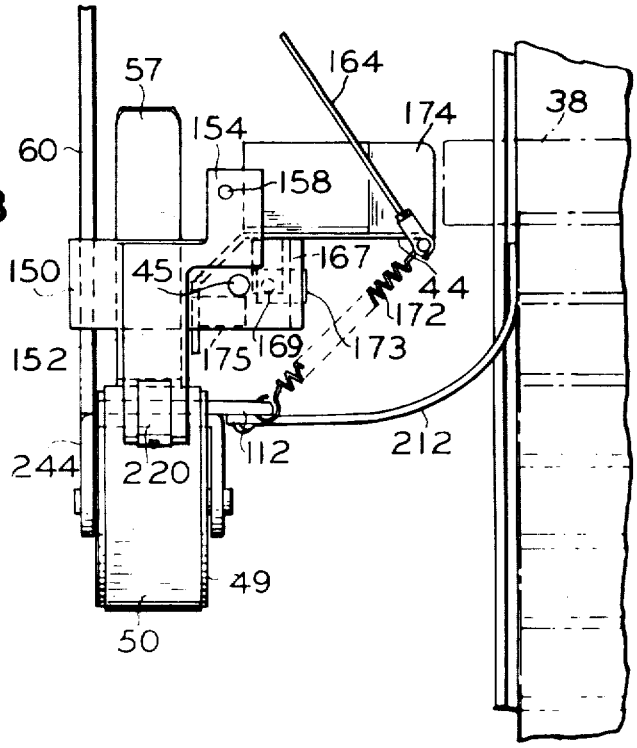
FIG. 8 is an end view of the apparatus shown in FIG. 7, taken along line VIII—VIII.

Secured at its lower end to the leg 112 of the U-shaped member 39 is a curved plate 212 (FIGS. 6 and 8) which extends toward the magazine, and then upwardly, its free end terminating at a level just below the tilt tray 44. The plate 212 acts to straighten the rows of coin tubes as the carriage is lowered, particularly those in the second highest layer, and blocks the movement of the second layer as the stripper strips the top layer onto the tilt tray. The coin rolls in the magazine are maintained in uniform orientation prior to being pushed onto the tilt table 44.

On the bottom leg 156 of the bracket 152, a limit switch 220 is provided, which cooperates with a bracket 222 secured to the belt 50. The belt is shown in FIG. 7 in the position in which it is ready to receive a new row of coin tubes from the tilt tray 44, and in that position, the stop bracket 222 is engagement with another limit switch 224, secured to a bracket 226 mounted to the lower arm 112 of the carriage 60. The switch 224 thus identifies the ready position of the belt 50. When the belt 50 has been advanced to cause all of the coin rolls to be removed from the transport conveyor, it is brought into engagement with the limit switch 220, which thus signals the empty position of the belt 50.

The pulleys 52 and 53 which support the belt 50, are supported by brackets 244 and 246 secured to the upper leg 112 of the carriage 60. The motor 55 turns, by means of a worm gear 250, the shaft of the sprocket 53 to drive the belt 50.

A light source and photocell combination 240 are provided to establish a light beam just above the ramp 66, to indicate the presence of a coin tube in position on the ramp. One of the pair 240 (FIG. 6) is secured to the bracket 162 (FIG. 5) below the lamp or photocell 160, and the other (not shown) is mounted beneath the lower leg 112 of the carriage 60. A light beam between the two is broken by the first coin roll on the ramp 66, which is not in position on a carrier 68, as illustrated in FIG. 6.

Another pair of light source and photocell 241 are located on the same brackets, but establish a light beam adapted to be broken when each coin tube is lifted by its carrier 68. The breaking of this light beam indicates the removal of a coin tube from the ramp 66, and signals the conveyor to be advanced to feed one additional coin tube to this ramp.

Similarly a pair of light source and photocell 250 and 252 are on opposite sides of the ramp 88, supported on the side walls 254. The light beam established between these two units is broken by the forth coin tube in the ramp 88. This light beam, when broken, insures that there are at least three coin tubes present on the ramp 68, which together provide sufficient weight to ensure that the lowest tube on the ramp fully enters the dispensing cylinder 90 for dispensing. Initial dispensing is delayed until at least three tubes are present on the ramp for that reason. A second pair of light source and photocell 251 establishes a light beam broken by the seventh tube on the ramp 68, and the elevator operates continuously until this condition is reached.

The shaft 92 has an extension 260, to which is secured a vane 262. The vane is adapted to interrupt a light beam between a pair of light source and photo detector 264 and 266, to indicate the position of the shaft 92. The light beam therefore indicates when a complete revolution of the escapement mechanism 90 has been effected.

A door 270 is supported for rotation on a shaft 272, in position above the ramp 94. When a coin roll is released from the dispensing cylinder 90, a coin tube, in rolling down the ramp 94, swings the door 270 open, pivoting it counterclockwise as illustrated in FIGS. 10 and 12. A vane 274 is secured to the door 270, and is adapted to interrupt a light beam between light source and photocell pair 276 and 278. The position of the vane 274 which interrupts the light beam is illustrated in FIG. 12. The opening of the door 270 is indicated by a signal caused when the light beam between 276 and 278 is interrupted.

From the various pairs of photocells and light sources, timing signals are developed which are used by the microprocessor 22 to control proper sequential operation of the parts of the apparatus. In addition, the light source and photocell pair 276 and 278, produce a signal when the door 270 is raised manually, and not by a coin roll as illustrated in FIG. 12. This can be used to sound an alarm signal indicating an unauthorized entry attempt.

Figure 14:
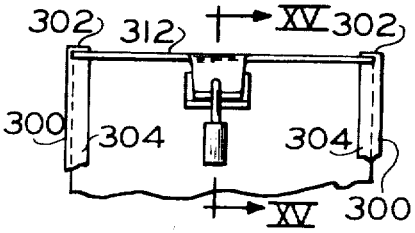
Figure 15:
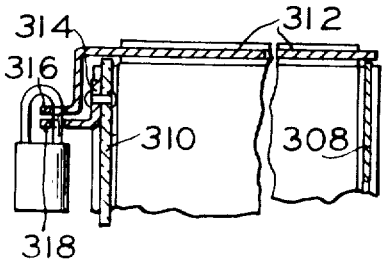

Referring to FIGS. 13–15, an arrangement is shown for a temporary cover for the magazine. Since the magazine is adapted to hold 2,000 to 3,000 coin tubes, it represents, when full, considerable monetary value. For that reason it is desirable to provide some security against theft, while the magazine is outside the dispensing machine. The amount of security required is minimal, however, because the loaded magazine is typically maintained in a secure area when not in place in the dispensing machine.

As shown in FIGS. 13, which is a plan view of the magazine, each of the side walls 36 has a bracket secured thereto which has an upper horizontal flange 302, and front and rear flanges 304 and 306, respectively. Vertical slots are defined by the flanges, so that a rear plate 308 and a front plate 310 can be slipped downwardly into the slots, covering the front and rear of the magazine. With the front and rear plates in place, a top plate 312 can be slipped into the slots formed below the flanges 302, as shown in FIG. 14, overlying the top ends of the front and rear plates, and preventing them from being removed. The top plate has a front panel 314 which extends down over the top of the front plate 310, ending in a tongue 316 which can be locked with a padlock or the like to a tongue 318 secured by rivets or the like to the front plate behind the panel 314. Preferably, the front plate 310 is made of transparent material such as Lexan or other transparent plastic, to allow an inventory check or an auditing check without requiring the removal of the covers. The total content of the magazine can be easily determined from outside inspection, merely by counting the layers of coin tubes, and multiplying by the number in each layer.

The function of the microprocessor 22 is to monitor the various photo detectors and limit switches, and to initiate operations as required, and as indicated by the signals from the photocells, to insure that a continuous series of coin tubes are present on the dispensing ramp 88. Some of the photo detectors and limit switches are used to establish that each operation is completed before a succeeding operation can begin. For example, the pusher 40 must be withdrawn to its forward extremity, in front of the magazine, before it can be lowered preparatory to a subsequent pushing operation. As it is well within the purview of those skilled in the art to program a microprocessor to carry out the operations described above in proper sequence, as described, the microprocessor and its program need not be described in detail herein.

The microprocessor is also preferably employed to control operation of the currency validator 16, and to determine that a valid bill has been received by the machine, and to rotate the dispensing cylinder 90 an appropriate number of revolutions, in response to the sensed denomination of the currency which has been received. Apparatus for validating and determining up to two denominations of currency is commercially available from several sources, and therefore need not be specifically described herein. The prefered apparatus is disclosed in the application Ser. No. 276,684, filed on even date herewith.

It will be apparent that various modifications and additions may be made in the apparatus of the present invention, without departing from the essential features of novelty thereof, which are intended to be defined and secured by the appending claims.

What is claimed is:

1. Change dispensing apparatus comprising, in combination; a magazine having means for supporting a plurality of coin rolls in plural stacked horizontal layers without intervening partitions, transport means for receiving a plurality of coin rolls in a group from said magazine and transporting them to a dispensing mechanism from which they are dispensed into a dispensing compartment, pusher means for pushing a group of the topmost layer of coin rolls of said magazine laterally toward said transport means, each of said layers being made up of plural rows and columns of coin rolls, and including a tilt tray adjacent said magazine for receiving a row of coin rolls as said topmost layer is pushed laterally, and means for rotating said tilt tray for swinging said coin rows from horizontal to vertical position on said transport means.

2. Apparatus according to claim 1, wherein said transport means includes a horizontal conveyor for conveying the coin rolls received from said tilt tray in single file toward said dispensing mechanism.

3. In a change dispensing apparatus adapted to dispense plural coin rolls maintained in a magazine, the combination comprising a transport conveyor for transporting coin rolls from said magazine along a horizontal path, with said coin rolls being supported in upright position on said transport conveyor, rotating means disposed at the end of said horizontal path for rotating said coin rolls from upright position to a horizontal position on an inclined ramp, and means for dispensing said coin rolls one at a time from said ramp.

4. Apparatus according to claim 3, wherein said transport conveyor comprises a horizontal conveyor belt for supporting said coin rolls in upright position, and wherein said rotating means comprises a hinged flap juxtaposed with an end of said conveyor belt for holding said coin rolls in an upright position while said flap is closed, said flap being adapted to be pushed open by coin rolls on said conveyor as said conveyor is advanced, allowing said coin rolls to rotate forwardly relative to the direction of motion of said conveyor as said coin rolls each approach the end of said conveyor and push said flap open.

5. In apparatus for dispensing a plurality of coin rolls stored in a magazine, and having a transport conveyor for transporting coin rolls toward a dispensing mechanism from said magazine, loading means for stripping a group of coin rolls from said magazine and loading them onto said conveyor, and means for operating said transport conveyor and said loading means asynchronously, said transport conveyor being operated whenever less than a predetermined number of coin tubes is in a predetermined position relative to said transport conveyor, and said loading means being operated to receive a group of coin tubes from said magazine immediately after said loading means has space available to receive said group, and to load them onto said conveyor as soon as said conveyor has reached its loading position.

6. Apparatus according to claim 5, including means for operating said transport conveyor to convey a group of said coin rolls toward said dispensing mechanism in serial order, and means for returning said conveyor to its loading position immediately after all of the coin rolls of said group have left said conveyor.

7. Apparatus according to claim 5, including an elevator mechanism interposed between said transport conveyor and said dispensing mechanism, and means for operating said elevator mechanism asynchronously immediately when there are fewer than a predetermined number of coin rolls in position to be dispensed by said dispensing mechanism.

8. In a dispensing apparatus for dispensing coins in the form of coin rolls from a magazine consisting of a plurality of layers of said coin rolls, the combination comprising supporting means for supporting the coin rolls of said magazine, dispensing means for unloading said coin rolls from said magazine and dispensing them, means for mounting a portion of said dispensing means for vertical adjustment relative to said magazine, in response to the number of said layers in said magazine, and means for mounting said suporting means for horizontal adjustment relative to said dispensing means, whereby said supporting means may be moved away from said dispensing means to allow replacement or replenishment of the magazine inventory.

9. Apparatus according to claim 8, including a case surrounding said magazine, said support means and said dispensing means, said case having a stationary section secured to said dispensing means and a movable portion secured to said support means, whereby the two portions of said case may be separated to allow replacement or replenishment of said inventory.

10. A coin dispensing apparatus having a magazine for storing plural coin rolls, a transport conveyor, means for feeding coin rolls from said magazine to said conveyor, an elevator, loading means for feeding said coin rolls from said conveyor to said elevator, a dispensing means for feeding coin rolls from said elevator to said dispensing means, sensor means for monitoring the condition of said magazine, said loading means, said elevator means and said dispensing means, and microprocessor means connected to and responsive to said sensor means for operating said loading means, said elevator means and said dispenser means asynchronously, for allowing dispensing of individual coin rolls in less time than required for a coin roll to travel from the magazine to the dispensing means and be dispensed.

11. Change dispensing apparatus comprising, in combination; a magazine having means for supporting a plurality of coin rolls in plural stacked horizontal layers without intervening partitions, transport means for receiving a plurality of coin rolls in a group from said magazine and transporting them to a dispensing mechanism from which they are dispensed into a dispensing compartment, and pusher means for pushing a group of the topmost layer of coin rolls of said magazine laterally toward said transport means, said supporting means being adapted to be surrounded by an external case when in position relative to said pusher means, and said magazine being adapted to be selectively removed from said external case for replacement thereof, said case being adapted to be opened to allow straight line motion of said magazine out of, and into the case.

12. Apparatus according to claim 11, wherein said supporting means is mounted on rollers, whereby said magazine can be rolled out of said case, and a substitute magazine rolled into said case.

13. Apparatus according to claim 11, including means secured to said supporting means for temporarily supporting walls surrounding the coin rolls within said magazine, when said magazine is outside said case.

14. Apparatus according to claim 13, wherein one of said walls comprises a transparent member, whereby the contents of said magazine are visable from outside said case.

15. Change dispensing apparatus comprising, in combination; a magazine having means for supporting a plurality of coin rolls in plural stacked horizontal layers without intervening partitions, transport means for receiving a plurality of coin rolls in a group from said magazine and transporting them to a dispensing mechanism from which they are dispensed into a dispensing compartment, pushing means for pushing a group of the topmost layer of coin rolls of said magazine laterally toward said transport means, said transport means including an elevator mechanism mounted in fixed position relative to said dispensing mechanism, and said transport means including stripping means for stripping a row of coin rolls from said magazine and means for transporting said stripped coin rolls to said elevator, and means for adjusting the vertical position of said stripping means in relation to said magazine to maintain said stripping means juxtaposed with the topmost layer of coin rolls in said magazine as all of the coin rolls in said magazine are dispensed.

16. Change dispensing apparatus comprising, in combination; a magazine having means for supporting a plurality of coin rolls in plural stacked horizontal layers without intervening partitions, transport means for receiving a plurality of coin rolls in a group from said magazine and transporting them to a dispensing mechanism from which they are dispensed into a dispensing compartment, pusher means for pushing a group of the topmost layer of coin rolls of said magazine laterally toward said transport means, said dispensing means comprising a hollow dispensing cylinder having an opening on one side, an inlet ramp juxtaposed with said cylinder for allowing coin rolls to roll into proximity with said cylinder, and enter said cylinder when it is in a first rotary position, and means for rotating said cylinder about its axis whereby said opening is rotated to a different position allowing the coin roll within said cylinder to be dispensed.

17. Change dispensing apparatus comprising, in combination; a magazine having means for supporting a plurality of coin rolls in plural stacked horizontal layers without intervening partitions, transport means for receiving a plurality of coin rolls in a group from said magazine and transporting them to a dispensing mechanism from which they are dispensed into a dispensing compartment, pusher means for pushing a group of the topmost layer of coin rolls of said magazine laterally toward said transport means, and support means for supporting said coin rolls in said magazine, said support means having corrugations whereby each of said coin rolls is supported with its end nearest to said transport conveyor elevated relative to its other end.

* * * * *